United States Patent [19]

Bowman et al.

[11] Patent Number: 4,526,419

[45] Date of Patent: Jul. 2, 1985

[54] BASKET AND TRAY ATTACHMENT FOR WHEELCHAIR

[76] Inventors: Albert M. Bowman, 14335 Sherman Way, #125, Van Nuys, Calif. 91405; Roy W. Wodtke, 15523 Rayen St., #6, Sepulveda, Calif. 91343

[21] Appl. No.: 511,526

[22] Filed: Jul. 7, 1983

[51] Int. Cl.[3] ..... A47B 83/02

[52] U.S. Cl. ..... 297/153; 297/194

[58] Field of Search ..... 297/153, 148, 149, 150, 297/154, 155, 194

[56] References Cited

U.S. PATENT DOCUMENTS

| | | | |
|---|---|---|---|
| 597,598 | 1/1898 | Yznaga | 297/155 |
| 2,131,122 | 9/1938 | Schlett | 297/194 X |
| 3,580,631 | 5/1971 | Murcott | 297/153 |
| 4,158,428 | 6/1979 | Bates | 297/148 |
| 4,449,750 | 5/1984 | Pultman | 297/153 |

FOREIGN PATENT DOCUMENTS

| | | | |
|---|---|---|---|
| 1460533 | 10/1966 | France | 297/153 |
| 1538543 | 7/1968 | France | 297/148 |
| 374221 | 6/1932 | United Kingdom | 297/153 |

*Primary Examiner*—Francis K. Zugel
*Attorney, Agent, or Firm*—Allan M. Shapiro

[57] ABSTRACT

Basket is mounted on slides which detachably and adjustably mount the basket on a wheelchair for convenient utilization by a person having strength in only one arm. A tray is detachably positionable within the top of the basket for use as a writing top or the like.

2 Claims, 2 Drawing Figures

FIG. 1
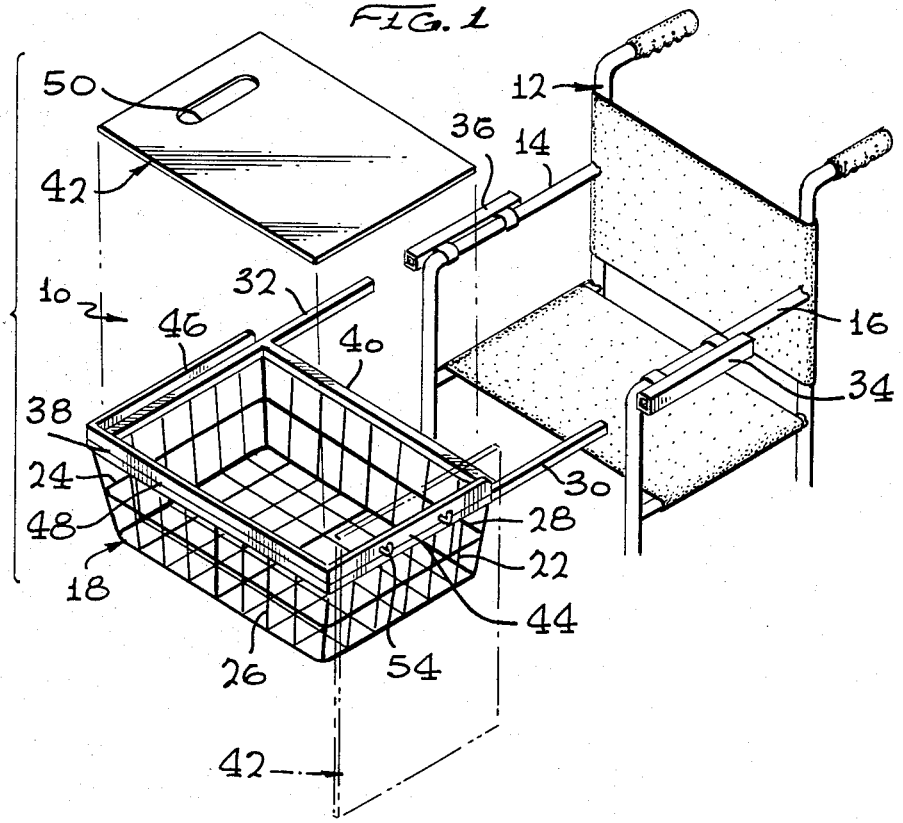
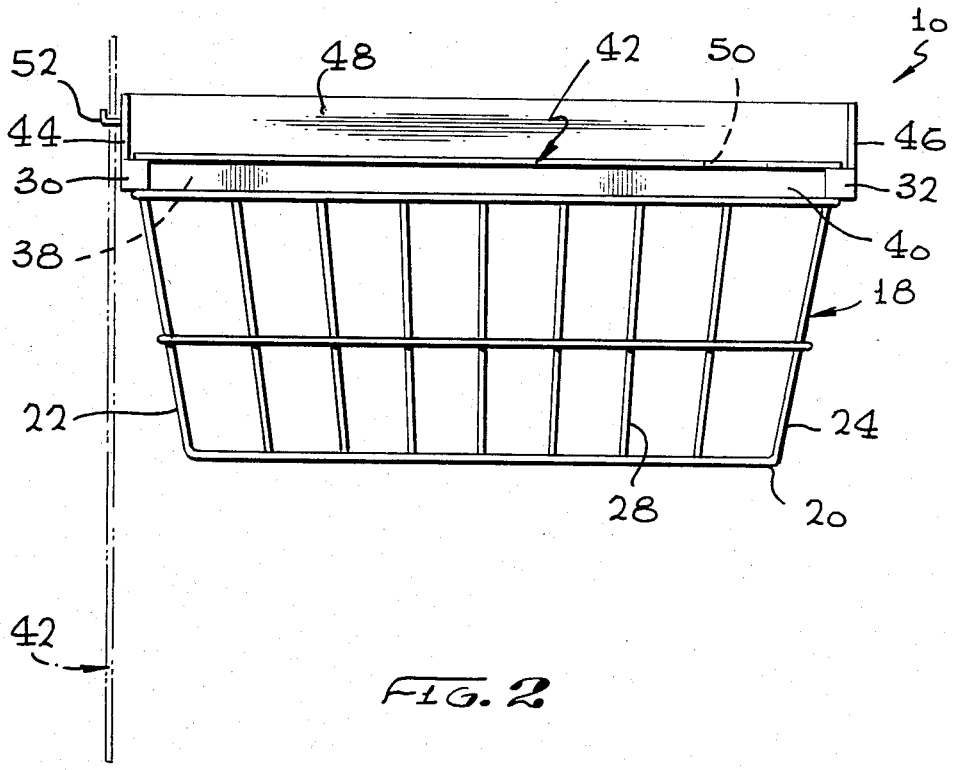
FIG. 2

BASKET AND TRAY ATTACHMENT FOR WHEELCHAIR

BACKGROUND OF THE INVENTION

This invention is directed to a basket and tray attachment for a wheelchair, with the structure arranged so that it can be handled and utilized by a person having strength in only arm, to provide that person with the capability of carrying things in the basket and/or utilizing the tray for various purposes.

Wheelchairs are well-known devices to provide mobility and support for those who have some kind of disability or weakness. In addition, detachable trays have been provided on wheelchairs to afford a convenient and useful space for the positioning of food or entertainment equipment such as books or games. However, such detachable trays have been designed for use by an attendant, rather than the disabled person. Such devices are not designed and configured for such utilization.

SUMMARY OF THE INVENTION

In order to aid in the understanding of this invention, it can be stated in essentially summary form that it is directed to a basket and tray attachment for a wheelchair, with a socket attached adjacent each arm of the wheelchair. The basket carries slides thereon which insert in the sockets. A rim on the basket detachably receives the tray.

It is, thus, an object and purpose of this invention to provide for a wheelchair a detachable basket which can be installed and removed with respect to the wheelchair by one hand so that it may be employed by a person having strength or manipulative capability in only one arm and hand.

It is a further purpose and advantage of this invention to provide a basket which can be attached and detached from a wheelchair by a person having capability in one hand and arm, with the basket further having a tray associated therewith which can be positioned on the top of the basket for use as a desk or counter top and which can be placed and removed with one hand and detachably hung on the basket when not in immediate use.

The features of the present invention which are believed to be novel are set forth with particularly in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of the basket and tray attachment for a wheelchair, shown in association with a wheelchair, with parts of the wheelchair broken away.

FIG. 2 is a rear elevational view of the basket and tray attachment, as seen from the wheelchair occupant's side of the basket.

DESCRIPTION OF THE PREFERRED EMBODIMENT

The basket and tray attachment of this invention is generally indicated at 10 in FIGS. 1 and 2. The basket and tray attachment is for detachable attachment to a wheelchair 12 which is partially shown in FIG. 1. The arms 14 and 16 of the wheelchair are illustrated, but the bottom portion of the wheelchair is broken away. The wheelchair 12 is preferably configured to be power-driven and steered so that it may be operated by a person with manual capability in only one arm. However, the wheelchair 12 may alternatively be unpowered so that it may be moved and positioned by an attendant. In such case, the wheelchair is positioned by the attendant while its occupant can attach, detach and utilize the basket and tray attachment 10.

Basket 18 is an open wire basket with a fine enough mesh to retain most items. It is formed into a basket shape to define a bottom 20, left and right ends 22 and 24, and front and back 26 and 28. The lateral dimensions between the front, back and ends is preferably such as to permit the carrying of two shopping bags. Left and right slides 30 and 32 are respectively attached to the basket at the top of the left and right ends 22 and 24. Slides 30 and 32 are of uniform cross section and are preferably of square configuration. The slides extend toward the wheelchair to extend beyond back 28. The slides are preferably square members and may be tubular to provide maximum strength with respect to weight. Left and right tubular guides 34 and 36 are respectively attached to the left and right arms 16 and 14 of the wheelchair. The tubular guides are sized to receive the slides. The slides are parallel to each other, as are the guides, and the guides are spaced to receive the slides. The basket may be picked up and controlled with one hand, and the slides are inserted into the guides. The basket is slid toward the wheelchair, and there are no latches to interfere with insertion or removal of the slides from the guides so that the basket may be installed and removed by a person having capability in only one hand and arm. The basket is, thus, supported by being cantilevered on the front of the wheelchair, and its position is easily adjustable by the wheelchair occupant by sliding the basket toward and away from him. With the cantilever support, the basket does not interfere with mobility and maneuverability of the wheelchair 12.

The left and right slides are formed as part of the top frame of the basket. In addition to the slides 30 and 32, the top frame of the basket includes a front bar 38 and a rear bar 40. These slides and bars are secured to each other, as by bending and/or welding to form a rigid frame structure to properly support the basket.

Tray 42 is a rectangular tray having its longer, lateral direction slightly shorter than the overall width across slides 30 and 32 and having its depth dimension equal to or slightly shorter than the distance across front and rear bars 38 and 40. In this way, the tray 42 can rest on top of the slides and front and rear bars. In order to limit lateral shifting of the tray on the slides and bars, left and right flanges 44 and 46 and back flange 48 are respectively secured at the top outer edges of slides 30 and 32 and rear bar 40 of the frame. As seen in FIG. 2, tray 42 rests within these flanges to provide a lateral constraint therefor.

As is seen in FIGS. 1 and 2, tray 42 has an opening 50 therein. Opening 50 is adjacent one end of the tray. Hooks 52 and 54 are provided on one or both of the flanges 44 and 46. In the present case, they are provided on the left flange 44, as seen in FIGS. 1 and 2. The hooks 52 and 54 are sized and positioned so that they may be received through the opening 50 in the tray so that the tray may be hung thereon, as is indicated in dashed lines in FIGS. 1 and 2. In this position, the tray is out of the way, but it is accessible and may be retrieved and placed by a person using only one hand and arm.

The basket 18 may be used for carrying shopping bags or various types of small packages or goods. In addition, it can be used for carrying an infant about a household. Tray 42 can have any convenient type of surface, and preferably has different surfaces on its opposite sides. One side could be formed as wood to serve as a desk top or cutting board, while the other side could carry a plastic laminate should such be desirable. One side of the tray could carry a bookstand or a clip to retain papers during writing. When used as a cutting board, a bowl may be placed in basket 18 before the placement of tray 42. Thereupon, one-handed use of the cutting board allows chopping, slicing or dicing with the finished product being swept through the opening 50 where it falls into the bowl. The cutting board can be used for the preparation of vegetables, fruits or salad materials as well as the slicing or dicing of meat. The cutting board surface may be provided with short spikes to hold the material in place during the cutting. Thus, the tray 42 is a multi-purpose tray which can be moved into place for use and removed and hung on the hooks for storage by a person having physical capability in only one hand and arm.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A basket and tray attachment comprising:

a frame, said frame having a front bar, a rear bar and first and second parallel slides extending rearwardly from said rear bar, an upstanding flange extending at least partway around said frame on said front bar and extending toward said rear bar, hooks on said slides of said frame forward of said rear bar;

a basket secured to said frame;

a tray detachably secured to said frame, said tray being sized to fit within said flange to laterally restrain said tray, said tray being sized to substantially cover said basket when said tray is laid over said basket, hook engagement means on said tray, said hook engagement means comprising an opening through said tray, said opening being sufficiently large for manual engagement so that said tray may be manually placed on said hooks and manually removed from said hooks and placed on top of said basket with one hand, said opening being sufficiently large so that when said tray is on top of said basket, materials can be passed from the top of said tray down through said opening into said basket;

first and second tubular guides respectively slidably engaged on said first and second slides, said first and second guides being for attachment to a wheelchair so that said slides may be slidably inserted into said guides to provide cantilever support for said frame, said basket and said tray with respect to said wheelchair, said slides sliding within said guides without locks or detents so that said slides can be inserted into and removed from said guides by one-hand engagement on said basket.

2. The basket and tray attachment of claim 1 wherein said tray has a top side and a bottom side, said top side and said bottom side of said tray being differently finished for different uses.

* * * * *